United States Patent [19]

Morton

[11] 4,186,535

[45] Feb. 5, 1980

[54] SHEAR LOAD RESISTANT STRUCTURE

[75] Inventor: Virgil R. Morton, Redondo Beach, Calif.

[73] Assignee: Verco Manufacturing, Inc., Phoenix, Ariz.

[21] Appl. No.: 936,176

[22] Filed: Aug. 23, 1978

Related U.S. Application Data

[63] Continuation-in-part of Ser. No. 805,523, Jun. 10, 1977, abandoned.

[51] Int. Cl.[2] ..... E04C 2/32

[52] U.S. Cl. ..... 52/250; 52/326; 52/795; 52/814

[58] Field of Search ..... 52/250,785,795–801, 52/814, 326, 406, 480, 336, 293, 732, 414, 319–321, 335, 450, 395

[56] References Cited

U.S. PATENT DOCUMENTS

| | | | |
|---|---|---|---|
| 583,685 | 6/1897 | Jackson | 52/336 |
| 1,240,634 | 9/1917 | Williams | 52/814 |
| 1,636,891 | 7/1927 | Barrows | 52/814 |
| 2,194,113 | 3/1940 | Covell et al. | 52/795 X |
| 2,485,165 | 10/1949 | Pollman | 52/582 X |
| 2,804,953 | 9/1957 | Buehler | 52/814 X |
| 2,992,711 | 7/1961 | Mitchell et al. | 52/795 X |
| 3,483,663 | 12/1969 | Gregoire | 52/293 |
| 3,656,270 | 4/1972 | Phillips | 52/732 X |
| 3,724,078 | 4/1973 | Carlin et al | 52/177 |
| 3,759,006 | 9/1973 | Tamboise | 52/814 X |
| 3,956,864 | 5/1976 | Fung | 52/414 |
| 3,973,366 | 8/1976 | Balanz | 52/100 |
| 3,995,403 | 12/1976 | Nickell | 52/493 X |
| 4,099,359 | 7/1978 | Sivachenko | 52/797 |

*Primary Examiner*—J. Karl Bell

*Attorney, Agent, or Firm*—Cahill, Sutton & Thomas

[57] ABSTRACT

The bottom flutes of a fluted deck or diaphragm of a building are fixedly attached to a horizontal load bearing member supported by vertical load resisting members. A load translation member, fixedly secured to the top flutes of the diaphragm and to the horizontal load bearing member, precludes relative movement between the top flutes en masse and the bottom flutes en masse. By precluding relative movement of the top and bottom flutes, the shear loads imposed upon the diaphragm by earthquakes and/or high winds are translated through the load translation member and the load bearing member to the vertical load resisting members.

13 Claims, 5 Drawing Figures

SHEAR LOAD RESISTANT STRUCTURE

This application is a continuation-in-part of my copending application entitled "SHEAR LOAD RESISTANT STRUCTURE", Ser. No. 805,523, filed on June 10, 1977, now abandoned and assigned to the present assignee.

The present invention relates to building structures and, more particularly, to diaphragms for resisting deformation due to horizontal shear loads.

In the field of building construction, diaphragms are elements in the horizontal plane disposed at the floor and roof levels which provide vertical support and resist horizontal shear loads. The types of horizontal shear loads of concern are shear loads primarily caused by earthquakes and/or high winds. Typically, variously configured metal decks or diaphragms have replaced earlier structural systems incorporating horizontal cross-bracing.

The shear resistance offered by diaphragms are dependent on a plurality of variables such as thickness of the deck, span of the deck and the type of connection intermediate the diaphragm supporting frame. Another factor to be considered is that of the stiffness of the diaphragm since a stiff diaphragm will reduce or limit the deflection of the building walls. Additionally, a stiff diaphragm will allow a larger sized diaphragm as its ultimate size is a function of the diaphragm deflection.

Recently, the International Conference of Building Officials, a body which has established the minimum earthquake and/or wind loads that buildings must be designed to resist, has increased the required earthquake induced load resistance capability by forty percent. Or, stated another way, in order for diaphragms to meet the increased standards published for use by architects and engineers, a diaphragm must be able to resist an additional forty percent load over previous requirements. To meet these higher standards, extensive investigations have been conducted to determine the points of failure resulting from shear loads. By destructive testing, it has been learned that presently used fluted decks, or variations thereof, tend to buckle and deform with little translation of the shear loads to horizontal shear load resisting members.

Various structures have been developed in an attempt to create diphragms which can resist high shear loads and which are stiff. A representative type of such structure is described and illustrated in U.S. Pat. No. 3,759,006. Herein, an open bay network diaphragm is developed from a plurality of longitudinally oriented frame members, each having a closed trapezoidal cross-section. Segmented transversely oriented trapezoidal members extend intermediate adjacent longitudinally oriented frame members. Means are disposed about the periphery of the diaphragm to create a modular-like unit for attachment to a skeletal building framework. Each of the diaphragms is relatively stiff and able to absorb shear loads; however, each diaphragm is not rigidly attached to the supporting framework. Instead, each diaphragm rests upon insulating wedges. Accordingly, little if any translation of shear loads from the diaphragm to the skeletal framework occurs. The following U.S. patents illustrate other types of structures useable as decks or diaphragms for buildings, U.S. Pat. Nos.: 583,685, 2,194,113, 2,485,165, 2,804,953, 3,483,663, 3,656,270, 3,973,366, 3,724,078, 3,956,864, and 3,995,403.

U.S. Pat. No. 2,992,711 is directed to structure for reinforcing the junction between a corrugated panel and a structural member in lightweight aircraft components. In essense, the structure contemplates the use of an external band of corrugated skin mating with the edge of the panel and a plurality of fingers of non-uniform length extend into the bottom opening corrugations, which fingers are physically locked in place with a bottom sheet extending along the bottom corrugations, the bottoms of the fingers and the bottom of the bar; a joggled member secures the top of the bar to the top of the skin. Spot welds are described as securing the elements to one another rather than ordinary surface welds. Since the structure is practical only for corrugations of $\frac{3}{8}''$ or less and material thicknesses of 0.002" to 0.016", it has no utility for building structures.

It is therefore a primary object of the present invention to provide a building structure capable of withstanding horizontal shear loads imposed by earthquakes and/or high winds.

Another object of the present invention is to provide a diaphragm for translating the horizontal shear loads imposed upon a building to vertical load resisting elements.

Yet another object of the present invention is to reduce the weight of a diaphragm by transferring any imposed shear loads to a supporting building framework.

Still another object of the present invention is to provide a means for precluding relative movement and buckling between flutes of a fluted diaphragm by translating the horizontal shear loads to a supporting framework.

A further object of the present invention is to provide a means for preempting the superimposition of shear loads upon the webs of a fluted diaphragm, which loads result from forces external to the building.

A yet further object of the present invention is to provide a means for stiffening a diaphragm with the use of lighter gauge materials.

A still further object of the present invention is to provide a building structure which is capable of withstanding high shear loads at a reduced net cost.

These and other objects of the present invention will become apparent to those skilled in the art as the description thereof proceeds.

The present invention may be described with greater specificity and clarity with reference to the following drawings, in which.

Figure 1:
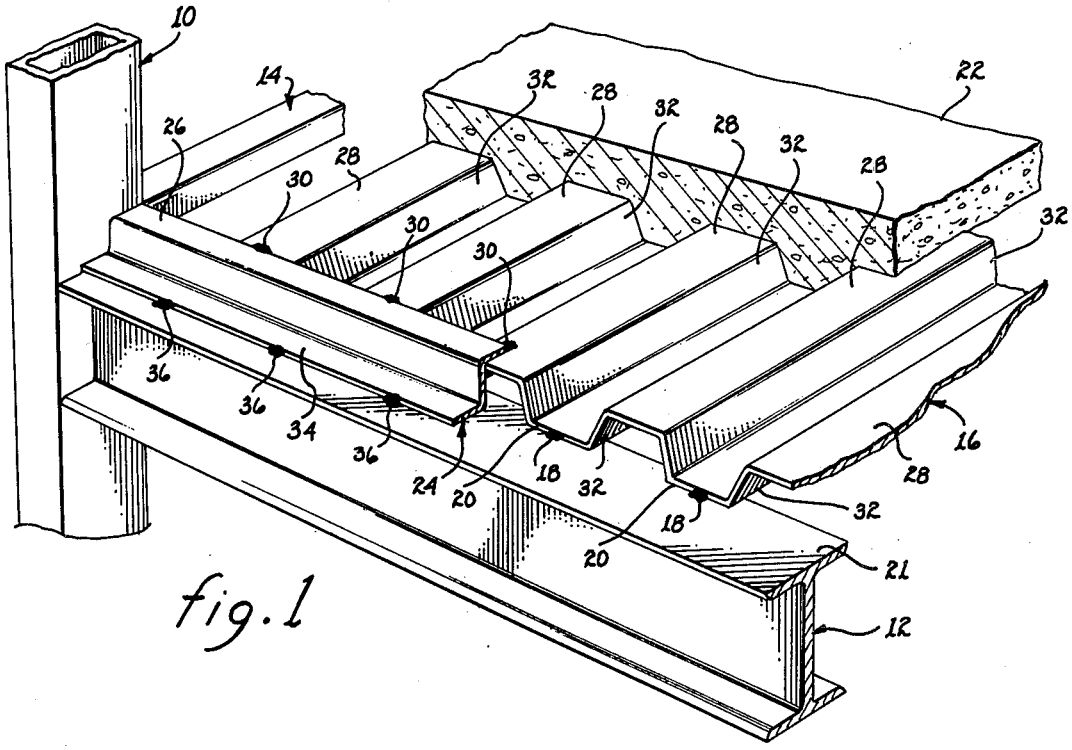
FIG. 1 is a perspective view of a diaphragm fixedly attached to a segment of a building framework.

Referring to FIG. 1, there is illustrated a segment of a building framework having a vertical load resisting member 10 supporting horizontal load bearing members 12 and 14. Horizontal load bearing member 12, which may be an I beam as depicted, supports one of the opposed open ends of a fluted deck or diaphragm 16. The diaphragm is attached to the horizontal load bearing member by means of welds 18 welding bottom flutes 20 to horizontal flange 21 of the I beam. It may be noted that puddle welds 18 bridge the edge of each bottom flute 20 with the planar surface of flange 21. Thereby, the bottom flutes are maintained in fixed spacial relationship to one another by the I beam. Concrete 22, or the like, may be poured upon diaphragm 16 to form the floor or working surface of the diaphragm.

Figure 2:
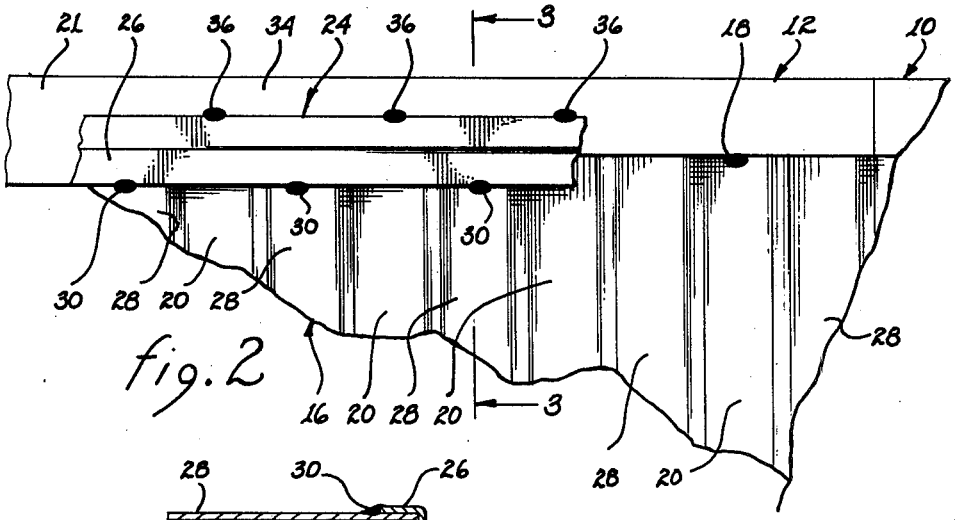
FIG. 2 is a partial cutaway top view of the interconnection intermediate a diaphragm and a building framework.
Figure 3:
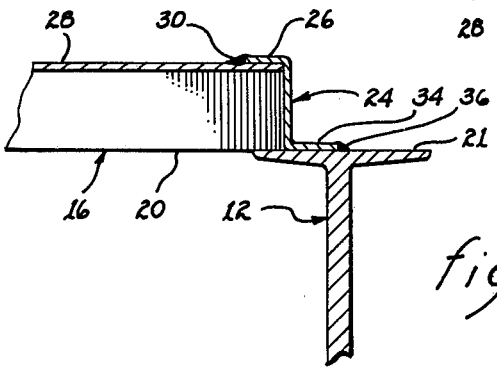
FIG. 3 is a cross-sectional view taken along lines 3—3 shown in FIG. 2.

With joint reference to FIGS. 1, 2 and 3, the structure for translating horizontal shear loads imposed upon diaphragm 16 to vertical load resisting member 10 will be described. A load translation member 24, which may be Z-shaped in cross-section as depicted or a C-shaped channel, is positioned adjacent each open end of diaphragm 16. Flange 26 of load translation member 24 is ridigly attached to top flutes 28 by welds 30. These welds bridge the longitudinal edge of flange 26 with the planar top surface of each top flute 28. Thereby, flange 26 of load translation member 24 maintains the top flutes in continuing spacial and fixed relationship to one another.

Movement of the top flutes en masse with respect to the bottom flutes en masse is now only possible through buckling, deformation or bending of webs 32 interconnecting the top and bottom flutes. By fixedly securing flange 34 of load translation member 24 to flange 21 of horizontal load bearing member 12 through puddle welds 36, positional movement of top flutes 28 along the axis of the load bearing member is precluded. As illustrated, puddle welds 36 bridge the longitudinal edge of flange 34 with the planar surface of flange 21 of the load translation member. Since the top flutes 28 are precluded from movement along the longitudinal axis of the horizontal load bearing member and as bottom flutes 20 are rigidly attached to flange 21 of the horizontal load bearing member, laterial displacement of the top flutes with respect to the bottom of the flutes is effectively precluded. Accordingly, buckling or other deformation of webs 32 will not and cannot occur until failure of load translation member 24 occurs.

Figure 4:
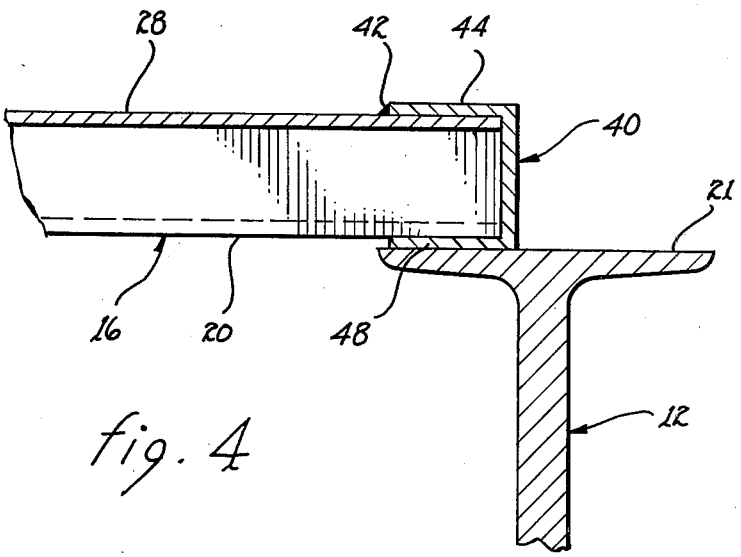
FIGS. 4 and 5 are cross-sectional views of a C channel interconnecting the end of a diaphragm with a load bearing member.
Figure 5:
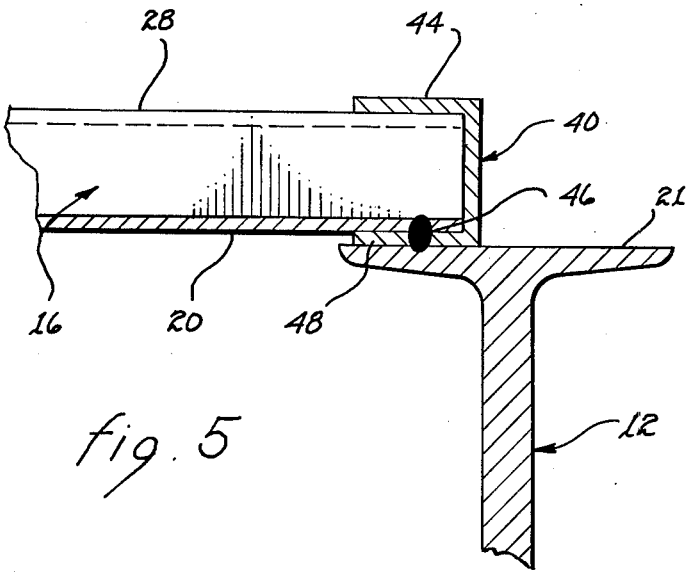

In the event the load translation member is a C-shaped channel, the top flutes would be welded to the upper flange as described above. The lower flutes, however would be welded by puddle welds to the lower flange of the C channel and to the supporting underlying load bearing member. The C channel, as a load translation member, would be used when two diaphragms are in abutting relationship or when the fluted end of the diaphragm must be positioned adjacent a vertical wall. More particularly, FIGS. 4 and 5 illustrate a C channel 40 interconnecting a diaphragm 16 with a horizontal load bearing member 12. Each top flute 28 of the diaphragm is welded by weld 42 to the edge of upper flange 44 of the C channel. Each bottom flute 20 is welded by a puddle weld 46 to both lower flange 48 of the C channel and to flange 21 of horizontal load bearing member 12. Thereby, the positional relationship of both the C channel with respect to the load bearing member and the bottom flute of the diaphragm with respect to the C channel are established.

Depending on the shear loads which might be imposed, the gauge of the diaphragm 16 may range between 24, 22, 20 or 18 gauge (nominal thickness being 0.0239", 0.0299", 0.0359" or 0.0478", respectively). The gauge of load translation member 24 is preferably of 16 gauge material (0.0598" thick) for two reasons. First, this thickness of material has sufficient mass to retain enough heat during welding to insure good welds between it and the diaphragm. Secondly, any failure due to excessive loads above predetermined calculated load bearing limits will occur in the diaphragm and not in the load translation member; thereby, the variables attendant shear load resistance are reduced and the specifications for a shear load resistant diaphragm building structure are more accurately determinable.

For most uses of the structure described herein, whether employed as a floor deck or a roof deck, sufficient strength and rigidity is obtained from 1½" fluted configuration; that is, the distance between the top surface of the upper flutes to the bottom surface of the lower flutes is 1½". For superior load capacities in long span configurations the thickness of the diaphragm may be increased to 3 inches.

When a building incorporating the present invention, is subjected to the tremors of a earthquake or high winds, horizontal shear loads will be imposed upon diaphragm 16. These shear loads, normally tending to displace top flutes 28 with respect to bottom flutes 20, will be translated through load translation member 24 to horizontal load bearing member 12. Consequently, displacement of the horizontal load bearing member along its longitudinal axis will tend to occur. Displacement of the horizontal load bearing member is effectively precluded by vertical load resisting member 10. As a result, the shear loads imposed will not be manifested in buckled or deformed diaphragms but will be resisted by the building framework members which are specifically configured to withstand expected horizontal shear loads imposed thereon.

Since the present invention tends to substantially increase resistance of a diaphragm to buckling or deformation, lighter gauge material for the diaphragm may be employed while maintaining an adequate safety factor. The permissible use of lighter gauge material reduces the material costs and fabrication techniques for the diaphragm. The additional cost of load translation member 24 and the labor costs of welds 30 and 36 does tend to offset the savings effected by lighter gauge material but the additional costs are proportionally less the larger the span or surface area of the diaphragm. The net commercial benefit is that of providing a structure of superior horizontal shear load capability while reducing the cost below that of conventional presently used diaphragms. To illustrate the savings possible, the following is presented as exemplary. A typical 200' by 200' department store has 40,000 square feet of horizontal area. Such a building would require 400 lineal feet of load translation member 24 at a cost of approximately twenty extra dollars. The shear loads for such a building would be approximately 900 pounds per foot and would require 18 gauge material for a conventional diaphragm structure. By use of the present invention, 20 gauge material may be employed to develop the same shear load resistance. The difference in price between 18 gauge and 20 gauge material is approximately twelve cents per square foot. The net savings resulting from a conversion of only half of the building to utilize the present invention would amount to about four cents per square foot. Larger buildings would produce greater savings while smaller buildings would show somewhat lesser savings. Nevertheless, in the highly competitive construction field, a savings of this magnitude is significant.

Aside from the benefits of greater shear load resistance for a given thickness of material for the diaphragm, the present invention also produces a stiffer diaphragm for any given material thickness. The added stiffness produces or promotes further savings possible through the use of larger diaphragms, reduction in the expected deflection of the vertical walls and a reduction in the number of shear walls required.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

I claim:

1. A diaphragm for translating horizontal shear loads imposed thereon through a supporting load bearing member to vertical load resisting members in buildings, said diaphragm comprising in combination:

a. a fluted deck, said fluted deck including webs alternately interconnecting top and bottom flutes terminating at opposed open ends defined by the extremities of said webs, said top flutes and said bottom flutes, said fluted deck having the opposed open ends supported by a load bearing member;

b. first welds for rigidly securing the ends of each of said bottom flutes of said fluted deck to the supporting load bearing member;

c. load translation means transversely located with respect to the flutes of said fluted deck for structurally interconnecting the top flutes of said deck with one another and with the load bearing member;

d. second welds for rigidly securing the ends of each of said top flutes of said deck directly to said load translation means; and e. third welds for rigidly securing the load bearing member directly to said load translation means;

whereby, said load translation means inhibits relative movement between and buckling of said top and bottom flutes of said fluted deck due to horizontal shear loads imposed upon said diaphragm and said load translation means translates the horizontal shear loads from said diaphragm to the load bearing member and ultimately to the vertical load resisting members.

2. The diaphragm as set forth in claim 1 wherein said load translation means comprises a Z-shaped member having a first flange welded to said top flutes and a second flange welded to the load bearing member.

3. The diaphragm as set forth in claim 2 wherein the end of each of said bottom flutes is welded directly to the load bearing member.

4. The diaphragm as set forth in claim 3 wherein said diaphragm is at least $1\frac{1}{2}$ inches in height from the bottom of said bottom flutes to the top of said top flutes.

5. The diaphragm as set forth in claim 1 wherein said load translation means comprises a C shaped channel having an upper flange welded to said top flutes and a lower flange welded to said bottom flutes.

6. The diaphragm as set forth in claim 5 wherein said first and third welds comprise the same welds.

7. A building for resisting horizontal shear loads imposed by earthquakes, high winds and the like, said building comprising in combination:

a. vertical load resisting members for absorbing horizontal shear loads imposed upon the building;

b. horizontal load bearing members attached to said vertical load resisting members for translating horizontal shear loads to said vertical load resisting members;

c. a diaphragm supported by said horizontal load bearing members, said diaphragm comprising in combination:

i. a fluted deck, said fluted deck including webs alternately interconnecting top and bottom flutes and defining a total thickness of said diaphragm of at least $1\frac{1}{2}$ inches;

ii. first welds for rigidly securing said bottom flutes of said fluted deck to at least one of said horizontal load bearing members;

iii. load translation means for structurally interconnecting said top flutes of said fluted deck with one another and with said one horizontal load bearing member;

iv. second welds for rigidly securing said top flutes of said fluted deck with said load translation means; and d. third welds for rigidly securing said load translation means with said horizontal load bearing member;

whereby, said load translation member inhibits relative movement between and buckling of said top and bottom flutes of said fluted deck due to shear loads imposed upon said diaphragm and said load translation member translates the shear loads imposed upon said diaphragm through said horizontal load bearing members to said vertical load resisting members.

8. The building as set forth in claim 7 wherein said load translation means comprises a Z-shaped member having a first flange welded to said top flutes and a second flange welded to the load bearing member.

9. The building as set forth in claim 7 wherein each of said bottom flutes is welded to the load bearing member.

10. The building as set forth in claim 7 wherein said load translation means comprises a C shaped channel having an upper flange welded to said top flutes and a lower flange welded to said bottom flutes.

11. The building as set forth in claim 10 wherein said first and third welds comprise the same welds.

12. A method for constructing earthquake resistant buildings having vertical load resisting members supporting horizontal load bearing members, said method comprising the steps of:

a. welding a fluted deck having webs alternately interconnecting top and bottom flutes to a horizontal load bearing member, said welding step including the step of welding bottom flutes of the fluted deck in proximity to a horizontal load bearing member;

b. welding a load translation means to top flutes of the fluted deck; and c. welding the load translation means to the horizontal load bearing member;

whereby the load translation means inhibits relative movement between and buckling of the top and bottom flutes of the fluted deck due to horizontal shear loads imposed upon the deck and the load translation member translates the horizontal shear loads imposed upon the deck through the load bearing member to the vertical load resisting members.

13. The method as set forth in claim 12 wherein said steps of welding said bottom flutes and welding the load translation means comprise a single step.

* * * * *

REEXAMINATION CERTIFICATE (275th)

United States Patent [19] [11] B1 4,186,535

Morton [45] Certificate Issued Nov. 20, 1984

[54] SHEAR LOAD RESISTANT STRUCTURE

[75] Inventor: Virgil R. Morton, Redondo Beach, Calif.

[73] Assignee: Verco Manufacturing, Inc., Phoenix, Ariz.

Reexamination Request:
No. 90/000,166, Feb. 25, 1982

Reexamination Certificate for:

| | |
|---|---|
| Patent No.: | **4,186,535** |
| Issued: | **Feb. 5, 1980** |
| Appl. No.: | **936,176** |
| Filed: | **Aug. 23, 1978** |

Related U.S. Application Data

[63] Continuation-in-part of Ser. No. 805,523, Jun. 10, 1977, abandoned.

[51] Int. Cl.[3] ..... E04C 2/32

[52] U.S. Cl. ..... 52/250; 52/326; 52/795; 52/814

[58] Field of Search ..... 52/250, 785, 795-801, 52/814, 326, 406, 480, 336, 293, 732, 414, 319-321, 335, 450, 395

[56] References Cited

U.S. PATENT DOCUMENTS

| | | | |
|---|---|---|---|
| 583,685 | 6/1897 | Jackson | 52/336 |
| 2,804,953 | 9/1957 | Buehler | 52/814 X |
| 2,832,300 | 4/1958 | Jacobson . | |
| 3,656,270 | 4/1972 | Phillips | 52/732 X |
| 3,724,078 | 4/1973 | Carlin et al. | 52/177 |
| 3,995,403 | 11/1976 | Nickell | 52/493 X |

OTHER PUBLICATIONS

FenCal Brochure-"LS Deck . . . ", Published 1964 through 1966.
Mahon Brochures-"NF Steel Deck", Bulletin NF-61, A.I.A., File No. 12 C, Published 1961.
Mahon Brochures-"NF Steel Deck", Bulletin NF-64, A.I.A., File No. 12 C, Published 1964.
ICBO Report No. 1092.8, dated Mar. 1, 1968.
ICBO Report No. 2229.2, dated Jun. 7, 1968.
ICBO Report No. 1388.9 dated Jul. 12, 1968.
ICBO Report No. 2334.1 dated Aug. 9, 1968.
ICBO Report No. 1113.11 dated Sep. 6, 1968.
ICBO Report No. 1405.8 dated Oct. 4, 1968.
Apr. 1959, "Report of Test Program on Mahon Steel Decks to Demonstrate Adequacy when Used as Horizontal Diaphragms", S. B. Barnes & Assoc., Los Angeles, Calif.
Mahon Brochure-"Mahon Steel Deck Roofs", Catalog No. D-63, A.I.A., File No. 12-C.
Mahon Brochure-"Mahon M-Floors, Steel Deck," Catalog No. D-68, A.I.A., File No. 12-C.
Mahon Brochure-"Mahon M-Floors, Steel Cellular Sub-Floors," Catalog No. M-68, A.I.A., File No. 17-A.

*Primary Examiner*—J. Karl Bell
*Attorney, Agent, or Firm*—Cahill, Sutton & Thomas

[57] ABSTRACT

The bottom flutes of a fluted deck or diaphragm of a building are fixedly attached to a horizontal load bearing member supported by vertical load resisting members. A load translation member, fixedly secured to the top flutes of the diaphragm and to the horizontal load bearing member, precludes relative movement between the top flutes en masse and the bottom flutes en masse. By precluding relative movement of the top and bottom flutes, the shear loads imposed upon the diaphragm by earthquakes and/or high winds are translated through the load translation member and the load bearing member to the vertical load resisting members.

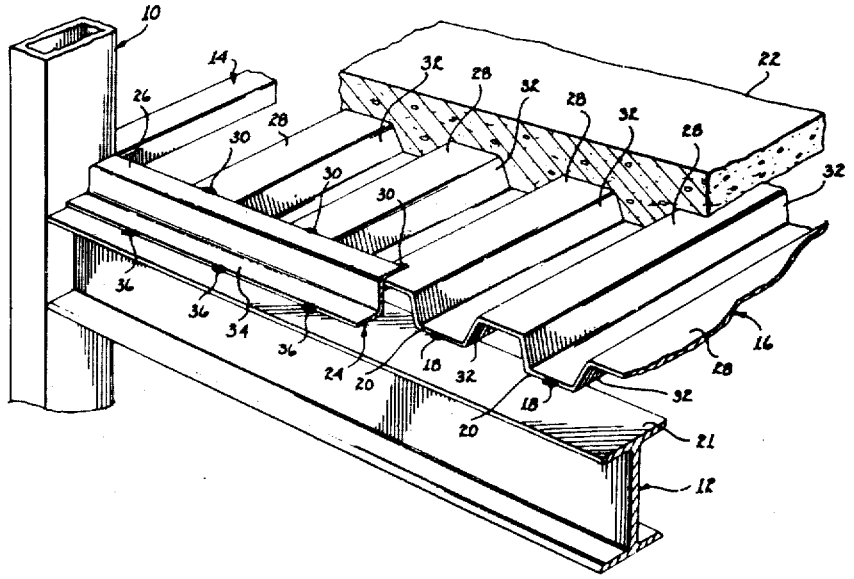

REEXAMINATION CERTIFICATE ISSUED UNDER 35 U.S.C. 307.

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 2, 5, 7–10 and 12 are determined to be patentable as amended.

Claims 3, 4, 6, 11 and 13, dependent on an amended claim, are determined to be patentable.

1. A diaphragm for translating horizontal shear loads imposed thereon through a supporting load bearing member to vertical load resisting members in buildings, said diaphragm comprising in combination:

[a. a fluted deck, said fluted deck including webs alternately interconnecting top and bottom flutes terminating at opposed open ends defined by the extremities of said webs, said top flutes and said bottom flutes, said fluted deck having the opposed open ends supported by a load bearing member:]

*(a) at least one integral seamless fluted deck panel including:*

*i. a plurality of top flutes disposed in an upper horizontal plane and a plurality of bottom flutes disposed in a lower horizontal plane, each of said plurality of top flutes and each of said plurality of bottom flutes having side edges extending parallel to the longitudinal axis of said fluted deck panel;*

*ii. a plurality of webs each extending upwardly from a side edge of a bottom flute to a side edge of a top flute, said plurality of webs alternately interconnecting said plurality of top flutes with said plurality of bottom flutes;*

*iii. each of said plurality of bottom flutes being connected to a first and a second of said plurality of webs at opposing side edges of said bottom flute, said first and second webs each extending upwardly at an angle to the vertical and extending in opposing horizontal directions to one another; and*

*iv. said plurality of top flutes and said plurality of bottom flutes terminating at opposed open ends defined by the extremities of said webs, said top flutes and said bottom flutes, said fluted deck panel having the opposed open ends supported by a load bearing member;*

(b) first welds for rigidly securing the ends of each of said bottom flutes of said fluted deck *panel* to the supporting load bearing member;

(c) *a* load translation [means] *member* transversely located with respect to the flutes of said fluted deck *panel* for structurally interconnecting the top flutes of said deck *panel* with one another and with the load bearing member, *said load translation member having an upper flange for engaging said plurality of top flutes and a lower flange parallel to said upper flange and interconnected thereto for engaging said load bearing member;*

(d) second welds for rigidly securing the ends of each of said top flutes of said deck *panel* directly to *said upper flange of* said load translation [means] *member*; and (e) third welds for rigidly securing the load bearing member directly to *said lower flange of* said load translation [means] *member*;

whereby, said load translation [means] *member* inhibits relative movement between and buckling of said top and bottom flutes of said fluted deck *panel* due to horizontal shear loads imposed upon said diaphragm and said load translation [means] *member* translates the horizontal shear loads from said diaphragm to the load bearing member and ultimately to the vertical load resisting members.

2. The diaphragm as set forth in claim 1 wherein said load translation [means] *member* comprises a Z-shaped member [having a first flange welded to said top flutes and a second flange welded to the load bearing member].

5. The diaphragm as set forth in claim 1 wherein said load translation [means] *member* comprises a C shaped channel having [an] *said* upper flange welded to said top flutes and [a] *said* lower flange welded to said bottom flutes.

7. A building for resisting horizontal shear loads imposed by earthquakes, high winds and the like, said building comprising in combination:

(a) vertical load resisting members for absorbing horizontal shear loads imposed upon the building;

(b) horizontal load bearing members attached to said vertical load resisting members for translating horizontal shear loads to said vertical load resisting members;

(c) a diaphragm supported by said horizontal load bearing members, said diaphragm comprising in combination:

i. [a] *at least one integral seamless* fluted deck *panel* [, said fluted deck including webs alternately interconnecting top and bottom flutes and] *including a plurality of top flutes disposed in an upper horizontal plane and a plurality of bottom flutes disposed in a lower horizontal plane, each of said plurality of top flutes and each of said plurality of bottom flutes having said edges extending parallel to the longitudinal axis of said fluted deck panel, said fluted deck panel further including a plurality of webs each extending upwardly from a side edge of a bottom flute to a side edge of a top flute, said plurality of webs alternately interconnecting said plurality of top flutes with said plurality of bottom flutes, each of said plurality of bottom flutes being connected to a first and second of said plurality of webs at opposing side edges of said bottom flute, said first and second webs each extending upwardly at an angle to the vertical and extending in opposing horizontal directions to one another, said fluted deck panel* defining a total thickness of said diaphragm of at least 1½ inches;

ii. first welds for rigidly securing said bottom flutes of said fluted deck *panel* to at least one of said horizontal load bearing members;

iii. load translation means for structurally interconnecting said top flutes of said fluted deck panel with one another and with said one horizontal load bearing member, *said load translation means*

*having an upper flange for engaging said plurality of top flutes and a lower flange parallel to said upper flange and interconnected thereto for engaging said one horizontal load bearing member;* iv. second welds for rigidly securing said top flutes of said fluted deck *panel* with said *upper flange of said* load translation means; and (d) third welds for rigidly securing *said lower flange of* said load translation means with said horizontal load bearing member;

whereby, said load translation [member] *means* inhibits relative movement between and buckling of said top and bottom flutes of said fluted deck *panel* due to shear loads imposed upon said diaphragm and said load translation member translates the shear loads imposed upon said diaphragm through said horizontal load bearing members to said vertical load resisting members.

8. The building as set forth in claim 7 wherein said load translation means comprises a Z-shaped member [having a first flange welded to said top flutes and a second flange welded to the load bearing member].

9. The building as set forth in claim 7 wherein each of said bottom flutes is welded [to the] *directly to said one horizontal* load bearing member.

10. The building as set forth in claim 7 wherein said load translation means comprises a C-shaped channel having [an] *said* upper flange welded to said top flutes and [a] *said* lower flange welded to said bottom flutes.

12. A method for constructing earthquake resistant buildings having vertical load resisting members supporting horizontal load bearing members, said method comprising the steps of:

(a) welding [a] *at least one integral seamless* fluted deck *panel* [having webs alternately interconnecting top and bottom flutes] to a horizontal load bearing member, *the fluted deck panel including:*

*i. a plurality of top flutes disposed in an upper horizontal plane and a plurality of bottom flutes disposed in a lower horizontal plane, each of said plurality of top flutes and each of said plurality of bottom flutes having side edges extending parallel to the longitudinal axis of said fluted deck panel;*

*ii. a plurality of webs each extending upwardly from a side edge of a bottom flute to a side edge of a top flute, said plurality of webs alternately interconnecting said plurality of top flutes with said plurality of bottom flutes; and*

*iii. each of said plurality of bottom flutes being connected to a first and a second of said plurality of webs at opposing side edges of said bottom flute, said first and second webs each extending upwardly at an angle to the vertical and extending in opposing horizontal directions to one another;* said welding step including the step of welding *the* bottom flutes of the fluted deck *panel* in proximity to a horizontal load bearing member;

(b) welding a load translation means to *the* top flutes of the fluted deck *panel, the load translation means having an upper flange for engaging the top flutes and a lower flange parallel to the upper flange and interconnected thereto for engaging the horizontal load bearing member*; and (c) welding *the lower flange of* the load translation means to the horizontal load bearing member;

whereby the load translation means inhibits relative movement between and buckling of the top and bottom flutes of the fluted deck *panel* due to horizontal shear loads imposed [upon the deck] *thereupon* and the load translation [member] *means* translates the horizontal shear loads imposed upon the *fluted* deck *panel* through the load bearing member to the vertical load resisting members.

* * * * *